US005487367A

United States Patent [19]

Lassiter

[11] Patent Number: 5,487,367

[45] Date of Patent: Jan. 30, 1996

[54] MOTORCYCLE CIRCUIT BREAKER IGNITION ADVANCE

[76] Inventor: Keith R. Lassiter, P.O. Box 432, Kearneysville, W. Va. 25430

[21] Appl. No.: 415,252

[22] Filed: Apr. 3, 1995

[51] Int. Cl.[6] ..... F02D 5/00

[52] U.S. Cl. ..... 123/420

[58] Field of Search ..... 123/420, 143 R, 123/146.5 R; 29/434; 200/190 R

[56] References Cited

U.S. PATENT DOCUMENTS

| | | | |
|---|---|---|---|
| 4,183,131 | 1/1980 | Seya et al. | 123/420 |
| 4,333,433 | 6/1982 | Mattson | 123/420 |
| 4,535,737 | 8/1985 | Takami | 123/420 |
| 4,538,564 | 9/1985 | Ehrmann et al. | 123/420 |
| 4,744,339 | 5/1988 | Nagai et al. | 123/420 |
| 4,955,330 | 9/1990 | Fabi et al. | 123/420 |

*Primary Examiner*—Raymond A. Nelli
*Attorney, Agent, or Firm*—J. Gibson Semmes

[57] ABSTRACT

An automatic advance unit as applied to the circuit breaker ignition of motorcycles. In the circuit breaker advance unit herein, flyweight roll pins are not set in the flyweights, per se, but they are mounted in the advance unit backing plate, ensuring that the flyweights are movable in perfect horizontal position. The advance unit assembly baseplate and centrally disposed breaker cam journal thereon has connection to a driving gear cam; opposed flyweight mounting pins project from the, backing plate and opposed flyweight mounting pins are on the backing plate, per se; opposed flyweight roll pins being set thereon, breaker cam spot pin is interposed on the plate including the breaker cam and flyweight roll pins. A breaker cam 9 is mounted in extension of journal of the backing plate, centrally thereof; centrifugally activated flyweights are slideably contacting contiguous portions of the baseplate.

6 Claims, 3 Drawing Sheets

MOTORCYCLE CIRCUIT BREAKER IGNITION ADVANCE

BACKGROUND OF THE INVENTION

This is an automatic advance unit as applied to the circuit breaker ignition of motorcycles, notably such as are utilized in the Harley-Davidson ignition system dated from the year 1970 to the present. The objective herein is to permit motorcycle users to obtain many additional miles of riding pleasure out of their motorcycles, without advance unit replacement, in accordance with the preferred system of the invention.

In the ignition circuit breaker advance unit of the invention, flyweight roll-pins are not set in the flyweights, per se but they are mounted in the advance unit backing plate, ensuring that the flyweights are moveable in perfect horizontal position, whereas in the prior art device, the flyweights on the advance unit set the roll-pins in the flyweights, per se, causing severe wear when centrifugal spinning of the advance unit is occurring. Thus in the instance of the prior art, the generated centrifugal force causes the flyweights to wear catty-cornered, which will allow them to rub against the timing plate, wearing them out in a shorter period of time than in the present ignition control system. The bottom of the flyweights of this invention ride in contiguous contact with the timing plate, a lubricant providing the only intermediate for surface to surface contact.

The centrifugally activated flyweights of this invention are mounted in such a manner that they may perform for a life of well over 5,000 miles without replacement. There is, to accomplish the present objective, a breaker cam with substantially shorter flyweight engaging slots and thus less tolerance between elements, reducing wear as opposed to existing competitive advance units. Advance units of prior art devices must be replaced at approximately every 1,000 miles because of excess flyweight wear occasioned by the design of the original issue advance unit. Other advantages of the invention include maintaining the compression springs holding the flyweights together as a unit, to function with the baseplate. Since the flyweights do not wear nearly as fast as in prior art assemblage, the invention herein yields more dependable and lengthy service. In the present system, shafts from the flyweights engage holes on the advance assembly baseplate per se, ant the breaker cam herein is of a unique dimension, as is the advance assembly shift. Likewise, the cut-out slot in the breaker cam herein is shorter, presenting less operative tolerance, therefore sustaining less wear than occurs in existing units.

SUMMARY

The present advance unit was created for application in Harley-Davidson motorcycles from 1970 and later. The mechanical structure of this advance unit must serve an improved basic function of the prior art advance unit on the market with enhanced efficiency. The moving parts on this unit present substantially less tolerance between parts and more lasting wear performance. The spinning occurs while the gear cam is in motion causes great centrifugal force while the engine is running. The breaker cam on the present advance unit has fifteen-thousands of an inch less end play, and at the base of this breaker cam 9' a 3/16"×3/8" cut on each side, this keeps the flyweights away from the tension springs. The measurements on the breaker cam that are on the market are 3/16"×7/16", presenting 1/16" more tolerance than the invention. The flyweight roll pins on the present advance unit are pressed in the advance assembly base itself, the N-drill sized hole is in the flyweights, the roll pins in the advance assembly baseplate are likewise on a 90° angle with the advance assembly baseplate; therefore when centrifugal force presses the flyweights against the roll pins, the flyweights stay flush with the advance assembly timing plate. This contact contiguous arrangement is made feasible by virtue of an enabling coat of oil. The flyweights that are on the market have their roll pins in the flyweights and approximately an N-drill sized hole in the advance assembly base. When centrifugal force occurs on their product, the roll pins that stick out of the flyweights into the advance assembly base force a severe twist on the flyweights which causes wear in the flyweight mounting pin hole. When this occurs the opposite end of the flyweight will rub the back of the breaker plate in a shorter period of time. This will cause a breakdown of the entire advance unit which will cause shutdown of the engine. The objectives of invention will thus be obvious from reference to the ensuing description and claims.

DESCRIPTION OF PRIOR ART

Figure 1:
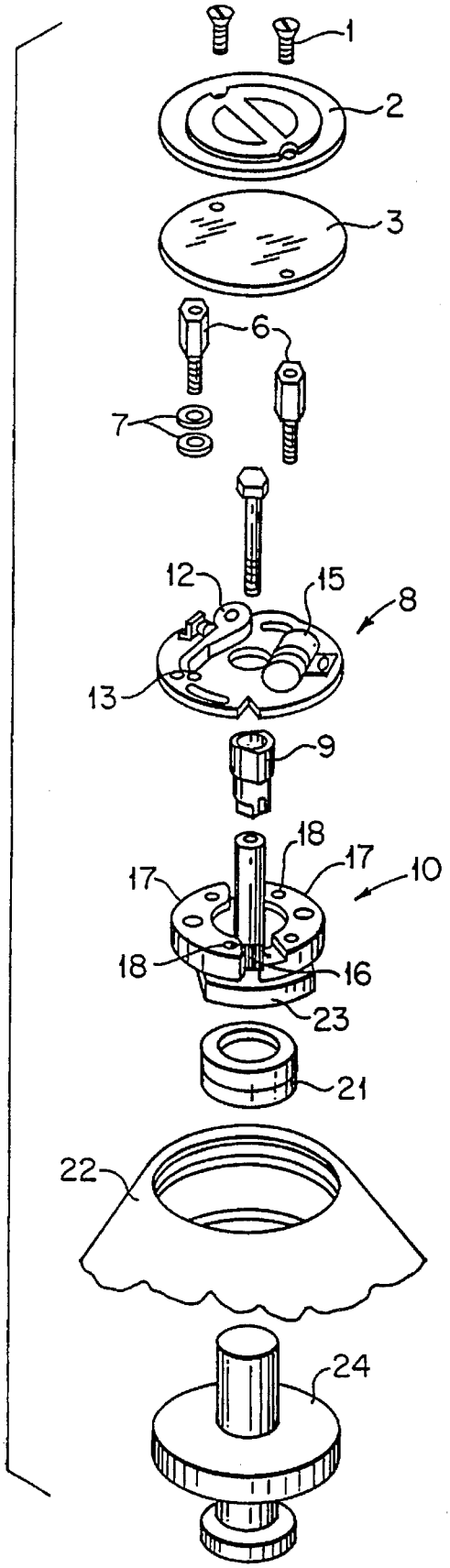
FIG. 1 PRIOR ART
FIG. 1 is an exploded view in perspective, illustrating complete details of an automatic advance unit of a Prior Art circuit breaker system.
Figure 1A:
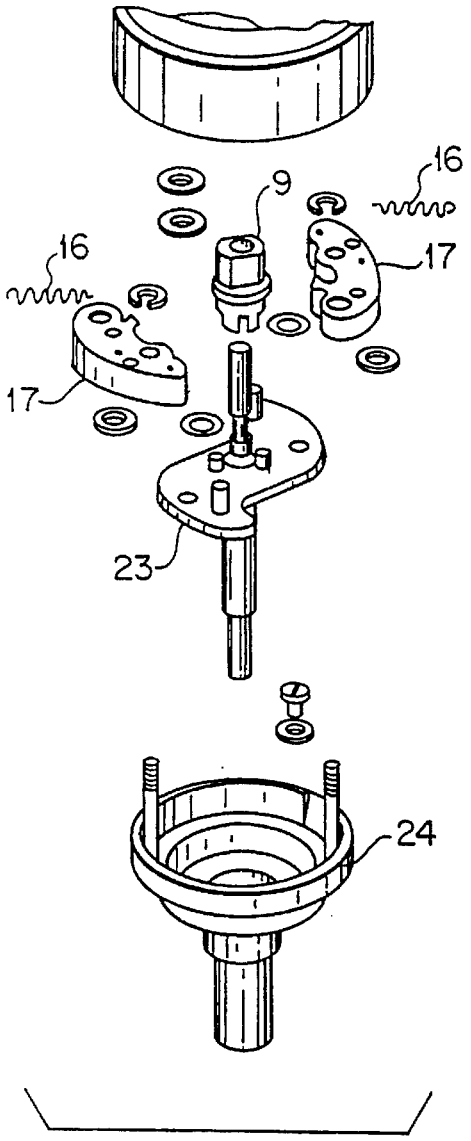
FIG. 1A PRIOR ART
FIG. 1A is a partial view in perspective of the Prior Art advance unit of FIG. 1, wherein specific details of the components, which are the subject of invention are depicted.

The prior art illustrated in FIG. 1 comprises in exploded detail, circuit breaker cover screws 1, securing circuit breaker cover 2 against the circuit breaker cover gasket 3, there being a wire terminal and wier 4 not shown; the circuit breaker cam bolt 5, not shown and the breaker plate screws 6, engaging breaker plate screw lock washers 7. The condenser is illustrated at 15. The breaker plate assembly 8 includes breaker contact screw 11, not shown, breaker contact assembly 12, breaker plate 13, condenser screw, lock washer 14 and condenser 15, each not shown. The advance assembly 10 of the prior art device includes breaker cam 9, also it comprises dual flyweight springs 16, dual flyweights 17 and flyweight roll pins 18. Roll pins 18 are each set into the flyweights 17, per se. A cam stop roll pin 19 is set in the baseplate 23, together with a register roll pin 20 each not shown in this FIG. 1. There is also illustrated cam shaft seal 21, gear case cover 22 and gear cam 24. Measurements of the parts, especially of the breaker cam, are critical. At the base of the breaker cam 9, respective trigger rotor cutouts are dimensionally 3/16" wide and 7/16" long.

DESCRIPTION OF THE INVENTION

The primed numbers appearing herein define new parts of the invention, FIGS. 2, 4, 6 and 8, that are related to like numbered parts of the prior art assembly, FIGS. 1, 1A, 3, 5 and 7. Contrasting the aforesaid automatic advance circuit breaker unit with the prior art: is the invention defined in FIGS. 2, 4, 6 and 8, as follows. Breaker plate assembly 8' and associated elements 4'–7' and 11'–15', as well as elements 1'–6' are not shown as they are the same as the conventional prior art elements of FIG. 1.

The essential elements of the present invention comprise advance assembly 10'. A side-by-side contrast of elements is reflected in FIGS. 1A and 2. They include: baseplate 23' in addition to the conventional elements, aforesaid. The breaker cam 9' is limitedly rotateable relative to the baseplate of advance assembly 10', see spot pin 9", FIGS. 2 and 8. Lans and grooves are machined into the interior wall of cam 9', to facilitate its lubrication during operation of the advance unit of the invention. The advance assembly further consists of expansion-compression springs 16', engageable with opposed ends of respective flyweights 17', the flyweights being centrifugally slideable, relative to baseplate 23'. The baseplate per se mounts the flyweight roll pins 18' which are press fitted into the baseplate and disposed in-line with the upstanding baseplate journal 23", upon which the breaker cam 9' is rotateably mounted. The dimensions of the breaker cam 9' are critical. The circumference at the top thereof is ½" and the elongate distance between the top and the first shelf is 21/32"; whereas the top shelf has a circumference of 19/32" which is the same as the elongate distance between the shelf and the bottom of the breaker cam 9', itself. Advance unit intime pin 20' is 3/32" in diameter. As suggested, the interior barrel of the breaker cam 9' is scored to form lans and grooves for retention of lubricant. See phantom lines of FIG. 6.

As indicated, the moving parts on the advance unit of the invention, FIGS. 2, 4, 6 and 8, present a substantial difference in tolerance between parts, but with enhanced efficiency and more lasting wear performance, since the spinning that is performed while the gear cam 24' is in motion, causes a great centrifugal force while the engine is running. The breaker cam 9' on the present invention has 0.015", fifteen-thousandths of an inch less end play than in its prior art counterpart, and at the base of the breaker cam 9' a 3/16"×3/8" vertical cutout on each side keeps the flyweights 17' away from the tension springs 16'. The measurements on the breaker cam 9 of the prior art are contrastingly 3/16"×7/16", which is 1/16" substantially more tolerance than found in the present invention. The flyweight roll pins 19' herein are press fit into the advance assembly baseplate, the receiving/mounting N-drill sized hole being in the flyweights 17', per se. The flyweight roll pins 18' in the advance assembly baseplate 23' are thus on a 90° angle, relative to the advance assembly base 23' itself. Thus, when centrifugal force activates the flyweights 17' against the roll pins 18', the flyweights remain flush with the advance assembly baseplate 23'.

Contrastingly, the flyweights 17 on the prior art assembly mount their roll pins 18 in the flyweights, per se. Its receiving/mounting N-drill sized hole is bored in the advance assembly, baseplate 23. Thus, when centrifugal force is applied to the prior art assembly, the roll pins 18 that extend outwardly of the flyweights into the advance assembly base, force a severe twist on those prior art flyweights 17, causing excessive wear in the flyweight mounting pin hole, relative to the flyweight roll pin 18. When this occurs, the opposite end of each respective prior art flyweight will rub and wear down the back of the breaker plate 23 in a shorter period of time, thus presenting a breakdown of the entire advance unit, ultimately causing a shutdown of the engine.

Figure 2:
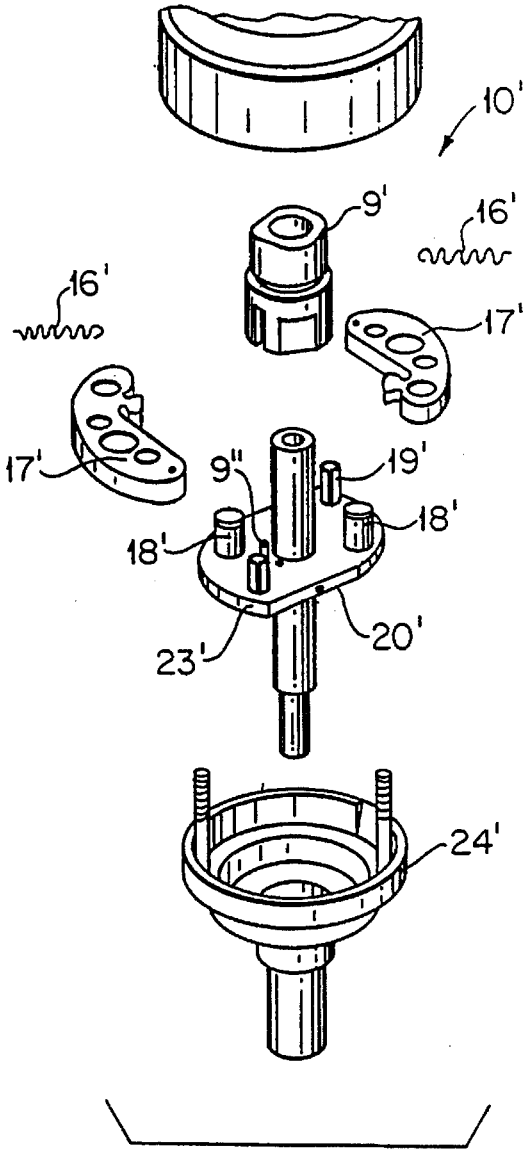
FIG. 2 is an exploded view of essential details of invention, depicting relative to FIG. 1A, the new counterpart automatic advance and illustrating the improved relationship between the correlative parts for a circuit breaker system of the same motorcycle, the advance herein being adapted to the same associated parts of the FIGS. 1 and 1A assemblages.
Figure 3:
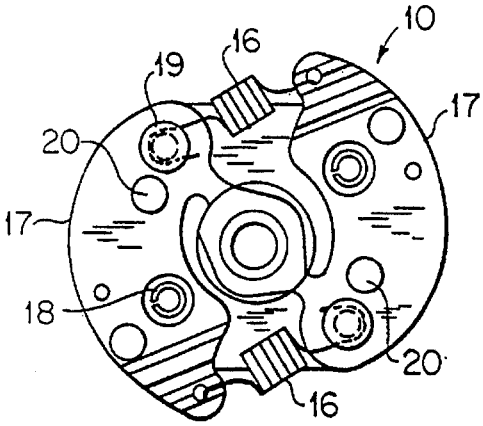
FIG. 3 PRIOR ART
FIG. 3 is a top plan view of the Prior Art advance unit of FIG. 1, restricted to the baseplate, its breaker cam journal, breaker cam and flyweights with associated parts.
Figure 4:
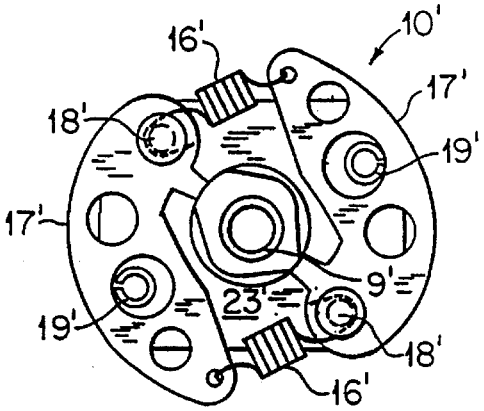
FIG. 4 is an expanded top plan, action view of the components of the invention contrasting to FIG. 3 Prior Art counterparts.
Figure 5:
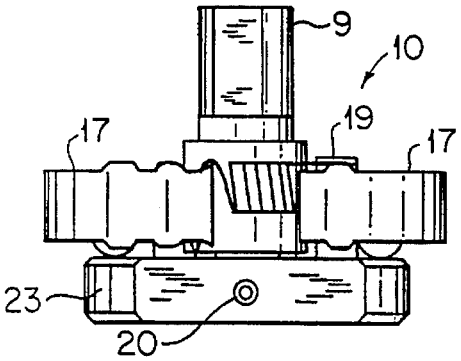
FIG. 5 PRIOR ART
FIG. 5 is view in side elevation of the FIGS. 1 and 3 Prior Art units.
Figure 6:
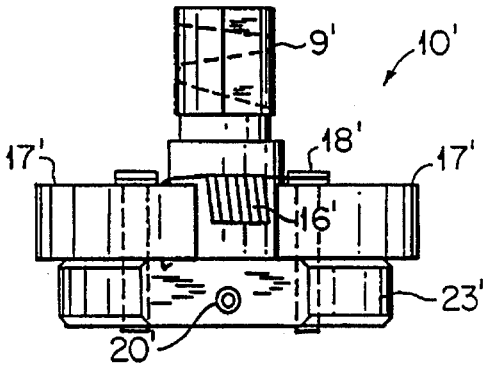
FIG. 6 is a view in side elevation of the invention advance unit of invention, contrasting to FIG. 5 counterparts.
Figure 7:
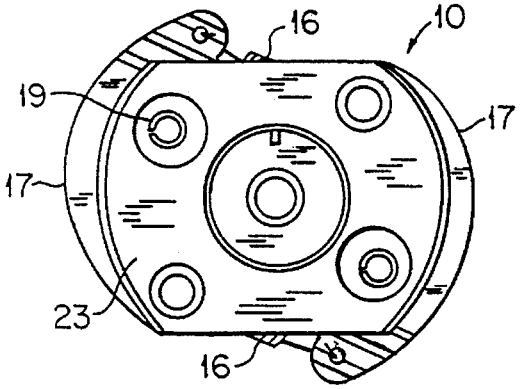
FIG. 7 PRIOR ART
FIG. 7 is a bottom plan view of the Prior Art device of FIGS. 1, 3 and 5.
Figure 8:
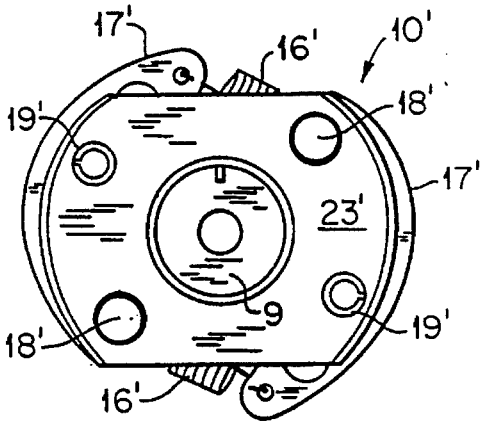
FIG. 8 is a bottom plan view of the invention advance unit, contrasting to FIG. 7 counterparts.

Critical to the invention are the respective compositions of the FIGS. 2 and 4 parts as follows:

Breaker cam 9' is composed of W-1 throw rod tooled steel.

Flyweights 17' are composed of stainless steel.

Flyweight roll pins 18', cam stop roll pin 19' and register roll pin 20' are respectively composed of throw rod tooled steel.

I claim:

1. In combination with circuit breaker ignition apparatus of motorcycle engines, an ignition advance unit, comprising:

a) an advance unit assembly base plate 23' and centrally disposed breaker cam journal 24" thereon, said backing plate journal having connection to a driving gear cam 24'; opposed flyweight mounting pins 19' projecting from the backing plate 23' and opposed flyweight mounting pins 19' on the plate 23'; opposed flyweight roll pins 18' thereon; breaker cam spot pin 6' interposed on the plate 23' between the breaker cam 9' and flyweight roll pins 18';

b) a breaker cam 9' mounted in extension of journal 24", centrally thereof;

c) centrifugally activated flyweights 17' slideably contacting contiguous portions of the baseplate 23, the flyweights being pivoted upon respective mounting pins 19' at opposed proximal breaker cam ends thereof, with tension springs 16' interconnecting distal ends of the flyweights 17' to the mounting pins 19', said flyweights having roll pins 18' which are press fit into the baseplate 23'.

2. The combination of claim 1 wherein the breaker cam 9' defines at its base opposed cutouts of the dimensions 3/16"×3/8", the flyweights 17' engaging from flyweight tension springs 16'.

3. The combination of claim 1 wherein an N-drill hole is in the flyweights 17' to encompass respective roll pins 18' and respective flyweight roll pins 18' are press fitted in the baseplate 23', at a right angle thereto, whereby as centrifugal forces contact of flyweights 17' against roll pins 18', the flyweights 17' remain in contiguous slideable contact with baseplate 23'.

4. The combination of claim 2 wherein an N-drill hole passes through the flyweights 17' to encompass respective roll pins 18' and respective flyweight roll pins 18' are pressed in the base plate 23' at a right angle thereto, whereby as centrifugal forces contact of flyweights 17' against roll pins 18', the flyweights 17' remaining in contiguous contract with advance unit assembly base 23'.

5. The combination of either claim 3 or 4 wherein roll pin holes in respective flyweights 17' are 5/16" in diameter and respective mounting pin holes in the flyweights are respectively of E-drill diameter.

6. The combination of either claim 3 or 4 wherein the breaker cam 9' defines lans and grooves interiorly to enhance lubrication thereof.

* * * * *